United States Patent [19]

Cox

[11] Patent Number: 4,784,516

[45] Date of Patent: Nov. 15, 1988

[54] TRAFFIC BEARING EXPANSION JOINT COVER AND METHOD OF PREPARING SAME

[75] Inventor: Harold A. Cox, Rochester, N.Y.

[73] Assignee: Harco Research, Inc., Rochester, N.Y.

[21] Appl. No.: 154,278

[22] Filed: Feb. 10, 1988

[51] Int. Cl.[4] ..... E01C 11/02; E01C 11/04

[52] U.S. Cl. ..... 404/69; 404/68; 404/67; 404/74; 14/16.5; 52/396; 52/403; 52/573

[58] Field of Search ..... 404/47, 56, 64–69, 404/73, 74; 52/396, 403, 573; 14/16.5

[56] References Cited

U.S. PATENT DOCUMENTS

| | | | |
|---|---|---|---|
| 3,824,025 | 7/1974 | Beutler | 404/68 X |
| 3,827,204 | 8/1974 | Walters | 404/66 X |
| 3,829,228 | 8/1974 | Miyazaki et al. | 404/68 |
| 4,080,086 | 3/1978 | Watson | 404/69 |
| 4,098,047 | 7/1978 | Weber | 404/68 X |
| 4,279,533 | 7/1981 | Peterson et al. | 404/68 |
| 4,285,612 | 8/1981 | Betti | 14/16.5 X |
| 4,295,311 | 10/1981 | Dahlberg | 404/69 X |
| 4,533,278 | 8/1985 | Corsover et al. | 404/67 X |
| 4,601,604 | 7/1986 | Clark et al. | 404/69 |
| 4,699,540 | 10/1987 | Gibbon et al. | 404/64 X |

FOREIGN PATENT DOCUMENTS

| | | | |
|---|---|---|---|
| 1409032 | 11/1968 | Fed. Rep. of Germany | 404/69 |
| 1509743 | 1/1968 | France | 404/69 |
| 1089007 | 11/1967 | United Kingdom | 404/68 |
| 1151187 | 5/1969 | United Kingdom | 404/68 |
| 1536684 | 12/1978 | United Kingdom | 404/69 |

*Primary Examiner*—Stephen J. Novosad
*Assistant Examiner*—John F. Letchford
*Attorney, Agent, or Firm*—Shlesinger, Fitzsimmons & Shlesinger

[57] ABSTRACT

Each of the recessed, confronting edges of adjacent concrete slabs in a roadway or the like has secured therein by a high density reinforced grout an elongated, rigid, prefabricated or precast edger strip, which also has an elongate recess in the edge thereof which faces on the space between the slabs. An elongate, semi-rigid, prefabricated cover member, which is generally T-shaped in cross section, has its upper, plate-shaped section positioned over the upper end of the space between the slabs so that opposite sides thereof project part way into the recesses in the edger strips, and has its downwardly projecting web section embedded in a sealing compound positioned between the confronting ends of the slabs. Remaining portions of the recesses in said edger strips are filled with a low modulus urethane compound.

14 Claims, 1 Drawing Sheet

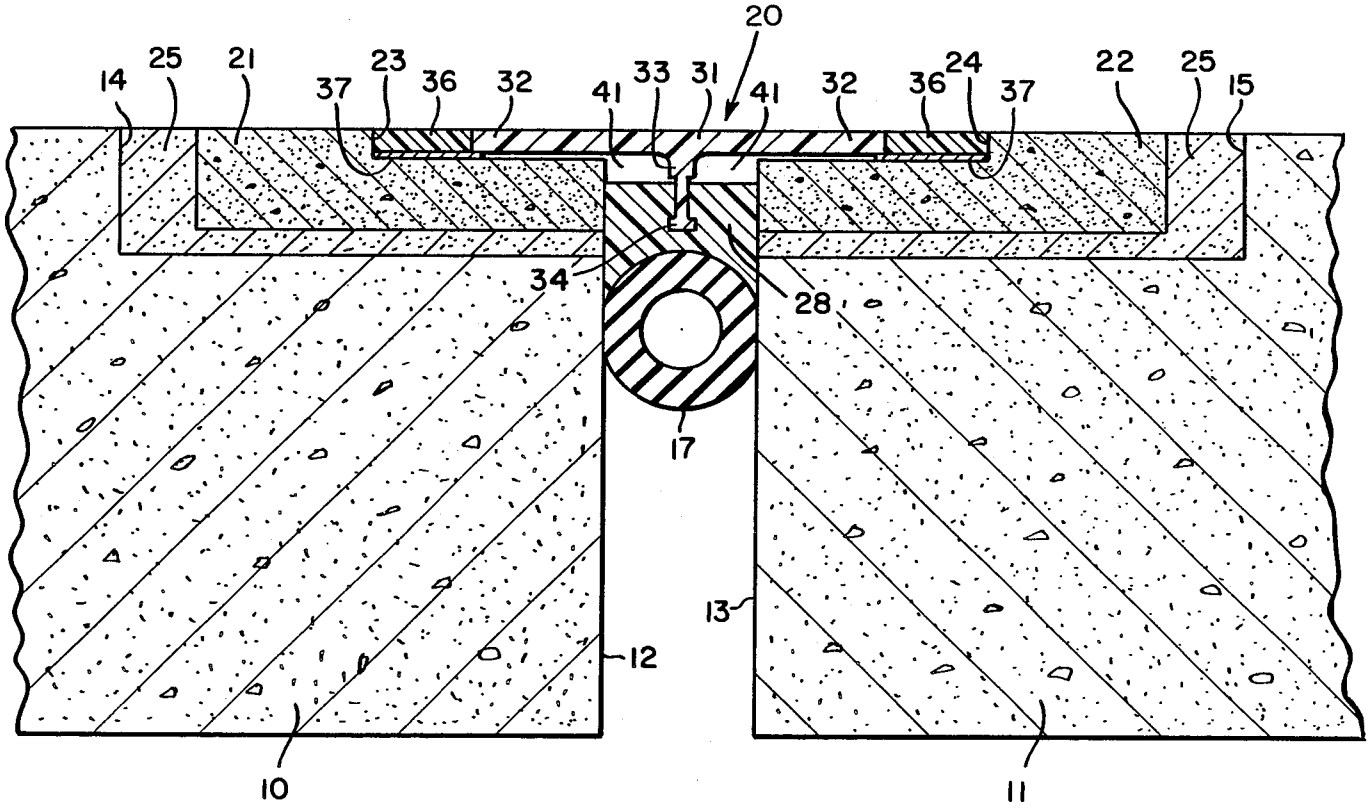
15
25
22
37
24
36
32
20
41
31
33
41
32
36
23
37
21
25
14
28
34
17
13
12
11
10

TRAFFIC BEARING EXPANSION JOINT COVER AND METHOD OF PREPARING SAME

BACKGROUND OF THE INVENTION

This invention relates to concrete highways or roadways, and more particularly to an improved, long-lasting cover for highway expansion joints, and a method for installing such covers between adjacent concrete slabs of a road or highway.

It has long been customary to form modern highways, and associated bridges and overpasses, from concrete slabs, which are poured one after the other along the length of the proposed highway or overpass to form a firm roadbed. Since concrete tends to contract and expand in response to falling and rising temperatures, respectively, it also has long been customary to interpose between the confronting ends of adjacent slabs resilient expansion joints. Such joints permit the slabs to expand and contract without unduly distorting the horizontal surface of the roadway; and they also prevent debris and water from entering the spaces between adjacent slabs. In the case of overpasses such joints prevent water and debris from dropping onto traffic passing beneath an overpass; and in the case of conventional roadways they prevent ice from forming between adjacent slabs and possibly interfering with the normal expansion and contraction of the slabs.

Among the solutions heretofore proposed, U.S. Pat. No. 4,080,086 suggests using elongated anchor pads, which are secured by studs and nuts to the upper surfaces of adjacent concrete slabs at the confronting ends thereof. These pads are connected to opposite sides of a flexible or resilient sealing member, which is thus supported by the anchor pads sealingly between the adjacent slabs. The disadvantage of this apparatus is that it requires a considerable amount of manual operations for bolting or mechanically securing the anchor pads to the concrete slabs.

In the structure taught by U.S. Pat. No. 4,285,612, a silica-epoxy mortar material is poured and tamped into confronting, notches or recesses formed in the confronting surfaces of adjacent slabs, and is allowed to set. Thereafter an elongate, resilient seal is inserted into the space between the strips of mortar, and a filler material is pumped into a bore in the center of the seal thus forcing the seal to expand outwardly into sealing engagement with the confronting edges of the now-cured mortar strips. With this construction, however, water or moisture is prevented from entering the space between the slabs only so long as the sides of the resilient seal remain sealingly engaged with the confronting surfaces of the strips of mortar.

The U.S. Pat. No. 4,098,047 teaches the use of an elongate, resilient, tubular seal having laterally extending side flanges, which are secured by a grouting material in opposed, longitudinally extending recesses formed in the confronting ends of a pair of adjacent concrete slabs. The tubular seal itself, however, remains exposed to the elements. U.S. Pat. No. 4,295,311 illustrates a somewhat similar expansion joint, but the latter joint is prefabricated all in one piece, and is then adhered by a plastic in confronting recesses formed in the adjacent concrete slabs.

U.S. Pat. No. 4,601,604 discloses a method of covering a resilient expansion joint or seal by pouring thereover a polyurethane layer, placing an extruded, plastic core over this layer, and then covering the core with still another layer of plastic, such as a fluid-polymer. At least two layers are thus poured over the resilient expansion joint after the latter has been inserted between the confronting surfaces of adjacent slabs. Instead of using a resilient seal between the confronting surfaces of adjacent slabs, U.S. Pat. No. 4,279,533 suggests securing a steel plate over the gap between the adjacent slabs, and then securing the plate in place with a plastic material.

Despite all the efforts heretofore made to provide a satisfactory traffic bearing seal between the confronting surfaces of adjacent concrete slabs, prior such products have not proved to be successful after being in use for relatively short periods of time. Traffic driving over the joint breaks down the upper, confronting edges of adjacent slabs. The breakdown progresses until the joint fails and requires major repairs. Moreover, prior such seals have required, more often than not, considerable work on the seam between slabs after the slabs have been poured.

It is object of the invention, therefore, to provide an improved expansion joint of the type described, which utilizes a novel cover means for covering and protecting the resilient seal, which is interposed between adjacent ends of two slabs to allow expansion and contraction thereof.

Another object of this invention is to provide an improved expansion joint cover of the type described which protects the upper edges of adjacent slabs at the intersections of the horizontal and vertical end surfaces of the slabs, thereby preventing traffic from breaking down such edges.

A further object of this invention is to provide an improved expansion joint cover of the type described which makes use of a number of preformed or precast elements, thus minimizing the time and effort required to install the cover during roadway formation.

Other objects of the invention will be apparent hereinafter from the specification and from the recital of the appended claims, particularly when read in conjunction with the accompanying drawing.

SUMMARY OF THE INVENTION

The expansion joint cover is designed to be mounted to overlie a conventional, resilient backer rod or seal, which is positioned snugly beneath the confronting end surfaces of a pair of adjacent concrete slabs of a highway. The upper, confronting edges of the slabs have therein longitudinally extending recesses which are right angular in cross section. Secured on the job in each such recess by a high density, reinforced bedding compound or grout, is an elongate, precast edger strip made from a high density, reinforced grout.

After the edger strips have been grouted in place, a low modulus urethane seal is poured over the backer rod. Before the seal sets, an elongate, prefabricated cover element, which is generally T-shaped in cross section, is positioned over the gap between the adjacent webs so that the opposed sides of the cover element project part way into recesses in the upper surfaces of the adjacent edger strips, and so that a central web section of the cover element extends downwardly into the still molten urethane sealing material to become embedded therein when the urethane solidifies. The remaining portions of the recesses in the upper surfaces of the edger strips, which are not occupied by the cover element, are then filled with a low modulus, traffic-bearing urethane.

THE DRAWING

FIG. 1, the only figure in the drawing, is a fragmentary cross-sectional view taken on a vertical plane through confronting ends of a pair of adjacent concrete slabs that form part of a highway, or the like, and showing in section a novel expansion joint cover made according to the teachings of this invention.

DETAILED DESCRIPTION OF THE PREFERRED EMBODIMENTS

Referring now to the drawing by numerals of reference, 10 and 11 denote a pair of adjacent, concrete slabs, which form part of a conventional roadway or highway. These slabs have confronting, spaced, vertical surfaces 12 and 13 which in practice extend transversely of the width of the roadway, or at least for a given portion of such width. The confronting, upper edges of the slabs 10 and 11 have formed therein elongate, transversely extending notches or recesses 14 and 15, respectively, which are right angular in cross-sectional configuration. Each of the recesses 14 and 15 extends for the full width of its associated slab 10 or 11. These recesses 14 and 15 are prepared or formed at the time that the respective slabs 10 and 11 are poured.

Secured between the confronting surfaces 12 and 13 of the slabs 10 and 11 in a slightly compressed form, is an elongate, tubular backer rod or seal 17, which may be of any conventional design. Normally the outside diameter of the rod 17 is larger than that of the space between the confronting slab surfaces 12 and 13, so that when the rod is tamped or otherwise pressed downwardly between the slabs it is slightly compressed in a radial direction, so that it is secured resiliently and snugly between the confronting surfaces 12 and 13. Rod 17 is designed to expand or contract with the adjacent slabs 10 and 11, thereby to prevent any debris or moisture from passing downwardly beneath the rod and into the remaining space between the slabs 10 and 11.

Secured over and protecting the resilient rod 17 is a novel expansion joint cover, which is denoted generally in the drawing by the numeral 20. Cover 20 comprises a pair of elongate, prefabricated edger units or strips 21 and 22, which are generally rectangular in cross-section, and which have in the upper surfaces thereof, as shown in FIG. 1, elongate grooves or recesses 23 and 24 which open on the end surfaces 12 and 13, respectively, of the slabs. Each of the strips 21 and 22 is designed to be secured in one of the recesses 14 and 15 in the slabs by a high density reinforced bedding compound or grout 25, and therefore is configured to be slightly thinner and narrower than the corresponding recess 14 or 15. During assembly the grout 25 is poured into the recesses 14 and 15 to form beds for the strips 21 and 22. The prefabricated strips 21 and 22 are then positioned in the grout 25 so that their recessed upper surfaces are disposed in coplanar relation wit the upper surfaces of the slabs 10 and 11, and so that their recessed edges are disposed in spaced, confronting relation to each other, and in coplanar, vertical registry with the slab surfaces 12 and 13, respectively.

After the edger strips 21 and 22 have been grouted in place, a low modulus urethane plastic material is poured into the space between the confronting edges of the strips 21 and 22, and on top of the backer rod 17 to form thereover, and between the confronting edges of the strips 21 and 22, a thick, resilient anchor or seal 28 of plastic material. It will be noted that the upper edge of the seal 28 terminates slightly beneath the recesses 23 and 24 in the edger strips 21 and 22.

Secured by the seal 28 across the space between the confronting edges of the edger strips 21 and 22 is an elongate, semi-rigid, precast urethane cover plate 31, which is generally T-shaped in cross-section. Cover plate 31 has coplanar, laterally extending flange sections 32, which extend into the confronting recesses 23 and 24 in the edger strips 21 and 22, and an integral, downwardly projecting web section 33, which is embedded in the urethane seal 28. Adjacent its lower edge the web section 33 is widened slightly as at 34 to form thereon opposed ribs which prevent withdrawal of the web section 33 from the anchor or seal 28.

It will be noted from the drawing that the flange sections 32 of the cover plate 31 project only part way into the registering edger strip recesses 23 and 24. The remaining portions of these recesses are filled with strips 36 of a low modulus, traffic bearing urethane material. Each filler strip 36 is seated upon a very thin layer 37 of a plastic material, which extends part way beneath the longitudinal side edge of the adjacent flange section 32 of the cover plate 31, and which forms a bond breaker as between the edger strips 21, 22 and the cover plate 31.

In its preferred form the prefabricated cover plate 31 is precast or otherwise produced in 4 to 6 foot lengths from a semi-rigid, high modulus urethane material, which may be the same type used to produce the grout 25, e.g., a strong (5000#—24 hrs.—1000#—28 days) reinforced grout. The lateral flange sections 32 of the upper, traffic-bearing portion of plate 31, are designed to cover or overlie from approximately 60–80% of the horizontal surfaces formed by the recesses 23 and 24 in the edger strips 21 and 22. The overall height of the cover 31 from its upper surface to the bottom of its web section 33 may be in the vicinity of one inch or greater. The various dimensions of the edger strips and cover element may, of course, vary depending upon the type of installation.

From the foregoing it will be apparent that the present invention provides a relatively simple and expeditious way to seal the seams between adjacent concrete slabs of a highway or the like. The edger strips 21 and 22 and the cover plate 31 are prefabricated, so that the only operations required to install the cover involve the pouring of the grout beds 25, the urethane seal 28 and the strips 36.

The bond breaker layers or strips 37 permit slight relative movement between the cover flange sections 32 and the slabs 10 and 11 as the latter expand and contract, and thus prevent the cover 31 from becoming dislodged or distorted in response to movement of the slabs. The low modulus filler strips 36 can compress and expand, for example in response to movements imparted to the edger strips 21, 22 by the slabs 10 and 11, without producing any significant disruption in the surface of the highway. Also, as shown in the drawing there are spaces or voids 41 formed above the seal 28 and beneath the flange sections 32 of cover 31 at opposite sides of the web section 33 to permit the seal 28 to expand upwardly upon expansion of the slabs 10, 11, and without interfering with the vertical position of cover 31.

While this invention has been illustrated and described in connection with only certain embodiments thereof, it will be apparent that this invention is capable of still further modification, and that this application is intended to cover any such modifications as may fall within the scope of one skilled in the art or the appended claims.

I claim:

1. An expansion joint for sealing the space between the spaced, confronting ends of a pair of adjacent, concrete roadway slabs having substantially coplanar upper surfaces, and spaced, confronting, transversely extending recesses formed in the confronting, upper edges thereof, comprising a pair of elongate, prefabricated edger strips secured in said recesses in said slabs in spaced, confronting relation to each other, a portion of the upper surface of each of said strips having therein an elongate, transversely extending recess opening on the space between said slabs, and the remaining portion thereof being substantially coplanar with the upper surfaces of said slabs, a resilient sealing element secured in and extending across the space between said slabs adjacent the upper end of said space, and an elongate cover member having a generally plate-shaped, traffic-bearing section overlying the upper end of said space between said slabs and projecting at opposite sides thereof, respectively, into said recesses in said edger strips, said cover member having an integral web section projecting downwardly from said traffic-bearing section and embedded adjacent its lower end in said sealing element, thereby to retain the upper surface of said traffic-bearing section substantially coplanar with the upper surfaces of said slabs.

2. An expansion joint as defined in claim 1, wherein said cover member is generally T-shaped in cross section.

3. An expansion joint as defined in claim 1, wherein said traffic-bearing section of said cover member is spaced above said sealing element, and said web section is narrower than said space between said slabs, whereby voids are formed beneath said traffic-bearing section and above said sealing element at opposite sides of said web section.

4. An expansion joint as defined in claim 1, wherein said cover member is made from a semi-rigid, high modulus plastic material.

5. An expansion joint as defined in claim 4, wherein said opposite sides of said traffic-bearing section of said cover member project only part- way into said recesses in said edger strips, and the remaining portions of said recesses in said edger strips are filled with a relatively low modulus plastic filler material.

6. An expansion joint as defined in claim 5, including a thin layer of a plastic, bond-breaker material secured in each of said recesses in said edger strips and extending beneath an adjacent side of said traffic-bearing section of said cover member.

7. An expansion joint as defined in claim 6 wherein said layers of bond-breaker material extend into said remaining portions of said recesses in said edger strips and beneath said low modulus filler material.

8. An expansion joint as defined in claim 4, wherein said edger strips are made from a high density reinforced grout.

9. An expansion joint as defined in claim 8 wherein each of said edger strips is a separate, precast strip, and said precast edger strips are secured in said recesses in said slabs by a high density reinforced bedding compound.

10. A method of producing an expansion joint between the spaced, confronting ends of a pair of adjacent concrete slabs in a roadway of the type in which the slabs are formed with spaced, confronting, transversely extending recesses in the upper edges thereof, comprising prefabricating a plurality of elongate, rigid edger strips having cross sectional configurations generally similar to but smaller than the cross sectional configurations of said recesses in said slabs, whereby each such edger strip has in one longitudinal side edge thereof an elongate recess extending longitudinally of the strip, prefabricating a plurality of elongate, semi-rigid cover members each of which is generally T-shaped in cross section, and each of which comprises a generally planar traffic-bearing section having a thickness approximately equal to the depth of said recess in said edger strips, and an integral web section projecting transversely from the underside of said traffic-bearing section centrally thereof, securing a pair of said prefabricated edger strips in the confronting recesses in a pair of said adjacent slabs with said recesses in said pair of edger strips opening on said space between the slabs and in spaced, confronting relation to each other, placing a molten sealing compound into the space between the confronting ends of said slabs with the level of said compound spaced beneath the recesses in said confronting edger strips, and while said sealing compound is still molten, inserting one of said cover members over the upper end of the space between said slabs so that opposite sides of said traffic-bearing section of said member project into the confronting recesses in said pair of edger strips, and so that the integral web section of said cover member projects downwardly into said molten sealing compound to become fixedly embedded therein when said compound solidifies.

11. A method as recited in claim 10, including precasting said cover members from a high modulus urethane.

12. A method as defined in claim 10, including precasting said edger strips from a high density reinforced grout.

13. A method of producing an expansion joint between the spaced, confronting ends of a pair of adjacent concrete slabs in a roadway of the type in which the slabs are formed with spaced, confronting, transversely extending recesses in the upper edges thereof, comprising inserting into the space between said slabs an elongate, flexible sealing element opposite sides of which sealingly engage the confronting end surfaces of said slabs beneath the recessed edges thereof, securing in each of said recesses in said confronting ends of said slabs an elongate, rigid, prefabricated edger strip having in one longitudinal side edge an elongate recess positioned to open on said space between said slabs, placing a molten sealing compound on top of said sealing element in the space between said slabs and the confronting ends of said edger strips, and while said compound is still molten, inserting over the upper end of said space between the slabs and said edger strips an elongate, semi-rigid, prefabricated cover member having opposed side edges which project part way into the confronting recesses in said edger strips, and having an integral web section projecting downwardly into the molten sealing compound to be fixedly embedded therein when the compound solidifies, and filling the remaining portions of said recesses in said edger strips, which are not occupied by said opposite sides of said cover member, with a resilient, low modulus, traffic-bearing compound.

14. The method as recited in claim 13, including securing said edger strips in said recesses in said slabs with a high density reinforced grout.

* * * * *

UNITED STATES PATENT OFFICE

CERTIFICATE OF CORRECTION

Patent No. 4,784,516 Dated November 15, 1988

Inventor(s) Harold A. Cox

It is certified that error appears in the above-identified patent and that said Letters Patent are hereby corrected as shown below:

In column 4, line 32, "1000" should be -- 10,000 --.

Signed and Sealed this

Eleventh Day of April, 1989

*Attest:*

DONALD J. QUIGG

*Attesting Officer*

*Commissioner of Patents and Trademarks*